US005521607A

United States Patent [19]

Deasy

[11] Patent Number: 5,521,607

[45] Date of Patent: May 28, 1996

[54] BANDSWITCHED ELECTRICALLY SHORT TACTICAL MONOPOLE ANTENNA SYSTEM

[75] Inventor: Richard E. Deasy, Cedar Rapids, Iowa

[73] Assignee: Rockwell International, Seal Beach, Calif.

[21] Appl. No.: 448,077

[22] Filed: May 23, 1995

Related U.S. Application Data

[63] Continuation of Ser. No. 104,836, Aug. 10, 1993, abandoned.

[51] Int. Cl.[6] ..... H01Q 9/04

[52] U.S. Cl. ..... 343/745; 343/750; 343/861

[58] Field of Search ..... 343/745, 749, 343/750, 861; H01Q 9/06, 9/04

[56] References Cited

U.S. PATENT DOCUMENTS

| | | | |
|---|---|---|---|
| 1,450,038 | 3/1923 | Hill | 343/745 |
| 2,854,667 | 9/1958 | Taylor et al. | 343/750 |
| 3,129,386 | 4/1964 | Daly | 343/852 |
| 4,564,843 | 1/1986 | Cooper | 343/745 |
| 4,656,483 | 4/1987 | Jaquet | 343/745 |
| 4,803,493 | 2/1989 | Jamison | 343/745 |
| 4,893,131 | 1/1990 | Smith et al. | 343/713 |
| 4,939,525 | 7/1990 | Brunner | 343/745 |
| 5,065,164 | 11/1991 | Deasy | 343/749 |
| 5,296,867 | 3/1994 | Jacquet | 343/745 |

*Primary Examiner*—Michael C. Wimer
*Attorney, Agent, or Firm*—Kyle Eppele; M. Lee Murrah; George A. Montanye

[57] ABSTRACT

A bandwidth-enhanced antenna system for operating on one of a plurality of selected frequency bands includes a whip or wire antenna element having band selection wires and a contiguous set of inductors arranged in series, each of the inductors being sufficiently separated from one another and being arranged such that the resonant frequency of any of said inductors is greater than the highest operating frequency of the plurality of frequency bands. Selector means is included provide a band select signal, and a plurality of switches each having a first terminal connected to a corresponding one of the inductors and a second terminal connected to the feed-end of the antenna element. The switches are responsive to the bandwidth select signal to allow communication using a selected one of the plurality of the frequency bands. An impedance matching network may be used for coupling an external receiver or transmitter to the feed-end of the antenna element.

5 Claims, 2 Drawing Sheets

BANDSWITCHED ELECTRICALLY SHORT TACTICAL MONOPOLE ANTENNA SYSTEM

This application is a Continuation of application Ser. No. 08/104,836, filed Aug. 10, 1993, now abandoned.

FIELD OF THE INVENTION

The present invention relates to radio antennas and, more particularly, to enhanced bandwidth electrically short tactical antennas which are capable of efficiently and selectively radiating energy over selected bands of a broad range of frequencies.

BACKGROUND OF THE INVENTION

Radio antennas which are used in modern applications, such as frequency hopping systems, are often required to operate over a range of frequencies. Monopole antennas commonly employed on tactical applications typically are electrically short (have mechanical length less than one-quarter wavelength) and have highly reactive impedances at lower operating frequencies. These antennas may be greatly mismatched with the load impedance of an associated transmitter thereby leading to serious losses in transmission efficiency. To minimize transmission inefficiencies, antenna coupling systems employing tunable, high-voltage load coils (variable inductors) have been developed which resonate the capacitive reactance of the associated antenna when the antenna length is less than one-quarter wavelength at the operational frequency. Such coupling arrangements result in a high Q series resonant, high-voltage, narrow-band, tuned condition which must be adjusted for every change in frequency, in order to assure efficient power transfer to the antenna. High-voltage tuning inductors are rather expensive and relatively slow in executing the retuning function and accordingly may not provide an adequate solution to antenna tuning for applications such as frequency hopping systems.

One successful technique and apparatus for overcoming these problems is described and illustrated in U.S. Pat. No. 5,065,164, entitled "Frequency Range Enhanced Monopole Antenna," which issued on Nov. 12, 1991. This approach provides an electrically short tactical antenna system which has inherently broader bandwidth characteristics in radiating radio frequency energy and also simplifies antenna coupling requirements. While this previous implementation is a significant improvement over prior art antenna implementations, there continues to be a need for an antenna system having even greater frequency range operating capabilities and a simplistic coupler apparatus.

SUMMARY OF THE INVENTION

The present invention provides a bandwidth-enhanced antenna system for operating on one of a plurality of frequency bands. More specifically, the antenna system includes: an antenna element having a plurality of non-resonant inductors arranged in series and having a feed-end and a far-end, each of the inductors being sufficiently separated from one another and being constructed and arranged such that the resonant frequency of any of the inductors is greater than the highest operating frequency of the plurality of frequency bands; a bandswitch unit connecting a contiguous set of the inductors on the feed-end of the antenna element; and a tuner unit to allow communication using a selected frequency band.

The above summary is not intended to describe each aspect of the present invention, as this is the purpose of the discussion that follows.

BRIEF DESCRIPTION OF THE DRAWINGS

Other objects and advantages of the invention will become apparent upon reading the following detailed description and upon reference to the drawings in which.

DETAILED DESCRIPTION OF THE SPECIFIC EMBODIMENTS

Figure 1:
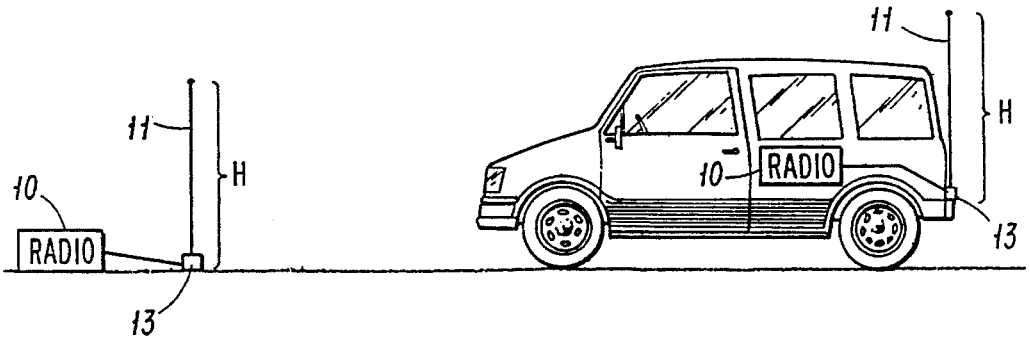
FIG. 1 shows one embodiment of the antenna system according to the present invention in both a vehicular and a field deployable configuration.

Referring now to the Figures wherein like items are referenced as such throughout, FIG. 1 shows alternate radios 10 that each include an antenna structure 11 that incorporates the teachings of the present invention. The antenna structure 11 and the radios 10 are shown both in ground and vehicular applications, which are typical for numerous tactical antenna arrangements. The antenna structure 11 may be supported at its base by coupling means 13.

Figure 2:
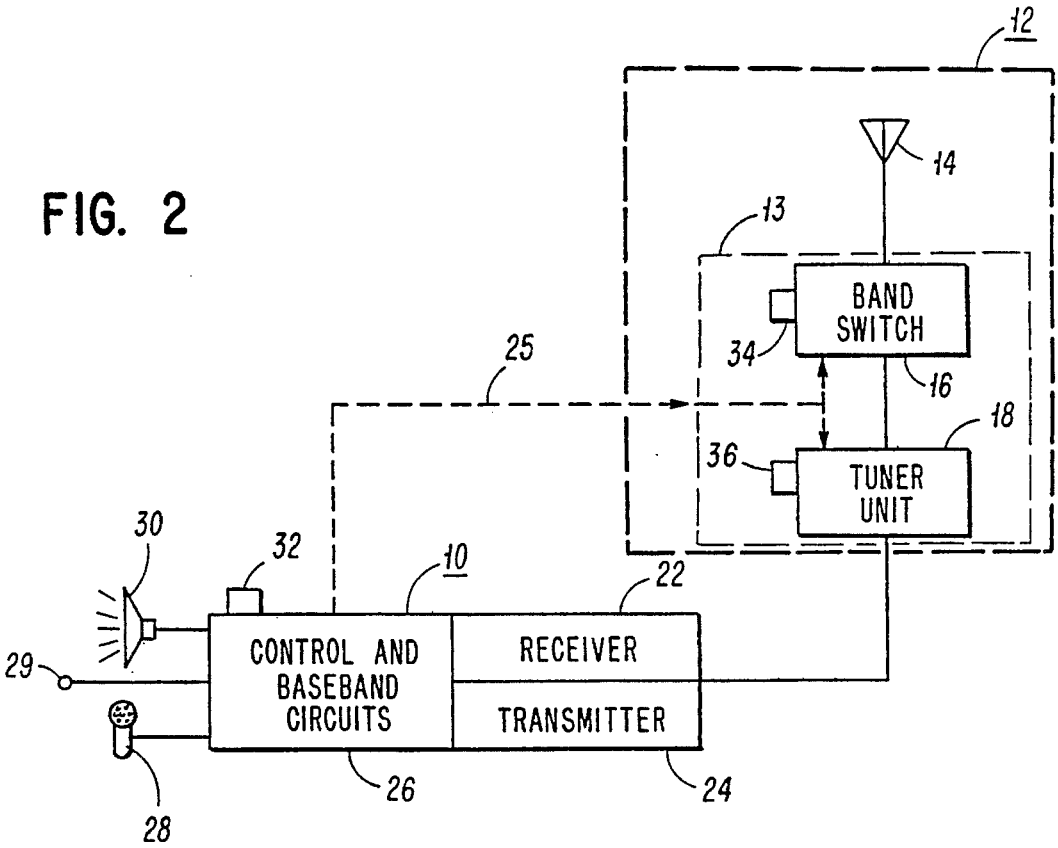
FIG. 2 is a block diagram of the antenna system of FIG. 1.

The antenna structure 12 includes a conductive antenna element 14, such as a conductive wire which is inclined in a predetermined fashion with respect to a ground reference plane as more clearly seen in FIG. 2. The antenna element 14 is dimensioned so as to have a length H which is approximately one-quarter wavelength at a higher operational frequency of the radio 10, having a transmitter 24 for which the antenna element 14 is the radiating means. In general, the antenna element 14 would constitute a standard "thin whip" antenna of the type capable of supporting itself in a vertically inclined position when mounted as depicted in FIG. 1.

FIG. 2 illustrates the antenna structure 11, the coupling means 13 and the radio 10 in block detail. The antenna structure 11 includes an antenna element 14, (a frequency range enhanced monopole antenna ("FREM") element described and illustrated in U.S. Pat. No. 5,065,164, incorporated herein by reference), and coupling means 13 which includes a bandswitch unit 16 and a tuner unit 18. The bandswitch unit 16, also herein referred to as selector means, is designed to allow a user of the radio 10 to select one of several frequency bands within which the antenna structure 12 has been designed to transmit and/or receive signals. The tuner unit 18 acts as an antenna coupler with switched capacitive and inductive elements arranged and value-selected for interfacing the radio transmitter 24 with the antenna element 14 and the bandswitch unit 16, and assisting in matching the impedance exhibited by the antenna element 14 to the required load impedance of the transmitter 24 for the operational frequency of the transmitter 24. At frequencies much less than one-quarter wavelength, a smaller amount of load coil is used in the tuner unit 18 to resonate the antenna element 14 (to "tune out" its capacitive reactance), providing a bandwidth relatively narrow, but significantly wider than with a conventional whip antenna.

The radio 10, is of conventional design and would typically include a receiver 22, a transmitter 24, and control and baseband circuits 26 for coupling baseband (analog and digital) signals to the antenna structure 12 via baseband means such as a microphone 28, terminal device 29, or a speaker 30. The radio 10 is also shown to include a frequency band selector dial 32 for selecting a frequency band within which the radio 10 will operate. Similarly, selector means 34 and 36 which may also be tuner dials, are included with the bandswitch unit 16 and the tuner unit 18, respectively, to establish the configuration of the antenna structure 12 and the proper impedance coupling for the selected frequency band. Preferably, the function of selector means 34 and 36 is implemented to be "automatic" by configuring the radio 10 to send a control signal, via a lead 25, to the bandswitch unit 16 and the tuner unit 18.

Figure 3:
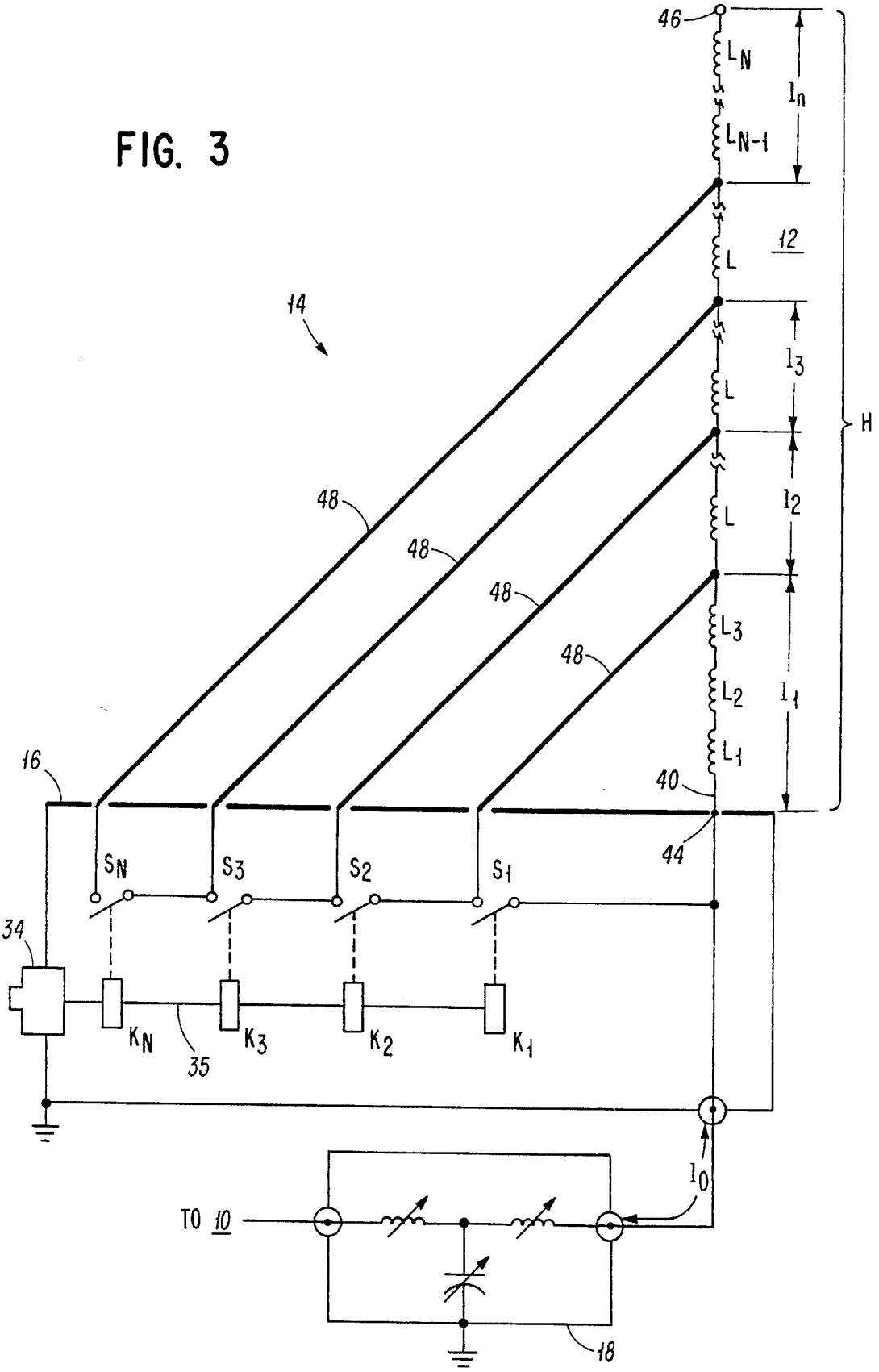
FIG. 3 is a schematic diagram of the antenna system of FIG. 1.

In FIG. 3, the antenna structure 12 is shown in schematic form. Antenna element 14 is shown to include a conductive wire (or thin whip) 40 and a plurality of band selection wires 48, which approaches one-quarter wavelength in length H for a predetermined range of frequencies over which the antenna structure 12 is intended to radiate (or receive) energy and is generally one-quarter wavelength of the mid or highest frequencies within its operating bands. The conductive wire 40 supports a large number of small inductors (or coils) $L_1$- $L_n$ which are installed along its length H in a deliberate pattern.

The inductors $L_1$- $L_n$ are positioned with sufficient distance between them so as to have negligible mutual inductive coupling, and to not electrically interact except as simple series circuit elements. It should be noted, however, that the inductors $L_1$- $L_n$ will generally exhibit increased amounts of capacitive interaction with the ground plane compared to the conductive wire 40. This interaction raises the characteristic capacity of the antenna structure 12 and affects the reactance introduced into the antenna structure 12 by the inductors $L_1$- $L_n$. This change in both capacitive and inductive reactance contributes to the improved performance of the present invention and increased bandwidth when used with the tuner unit 18.

The inductors $L_1$- $L_n$ are sized to be sufficiently small so that they have no individual resonances (e.g. resulting from the self-inductances and capacitances of the individual inductors) within the frequency range over which the antenna is intended to operate. The small sizing of the inductors $L_1$- $L_n$ prevents the electrical characteristics of the individual inductors from separately interfering with the overall operational characteristics of the antenna structure 12. This provides the most significant bandwidth improvement compared with conventional use of resonant load coils.

In a specific embodiment of the present invention, the antenna structure 12 might constitute a "thin whip" of approximately sixteen feet in length H mounted at its feed-end 44 on a vehicle, such as a truck, which would be intended to operate over a radio frequency range from 2 Mhz to 30 Mhz (the military HF band). A large number of small inductors $L_1$- $L_n$ such as twenty-eight inductors, would be installed along the length H of the conductive wire 40. The inductors $L_1$- $L_n$ would be of relatively small size each having approximately one-half micro-Henry of inductance, spaced approximately six inches apart. This configuration would lower the natural resonant length of the antenna structure 12 from 15 Mhz to approximately 8.5 Mhz. The value of the length 10, the distance between the bandswitch unit 16 and the tuner unit 18 is preferably relatively short and implemented using coaxial cable.

The antenna structure 12 may be optimized by adjusting the spacing and the size of inductors $L_1$- $L_n$ with respect to the ends 44 and 46 of the conductive wire 40. It is preferred that the distances $l_1$- $l_n$ between the inductors $L_1$- $L_n$ should progressively decrease toward the far-end 46 of the conductive wire 40, approximately logarithmically, although any positioning pattern in which the greater number of inductors $L_1$- $L_n$ are located toward the far-end 46 of the antenna element 14 is beneficial. Improved performance may be achieved by having the inductance values of the inductors $L_1$- $L_n$ progressively increase in a linear fashion from the first inductor $L_1$ to the last inductor $L_n$. For further information concerning the theory of the antenna element 14, as depicted between ends 44 and 46, reference may be made to the above-mentioned U.S. patent.

The bandswitch unit 16, in combination with the selector means 34 described above, acts as a bandswitch controller. A plurality of switches $S_1$- $S_N$, each having a first terminal connected to a corresponding inductor $L_1$- $L_n$ and a second terminal connected to the feed-end 44 of the antenna structure 12. The selector means 34 is used to choose the frequency band by selectively configuring switches $S_1$- $S_N$.

The tuner unit 18 may be implemented using a conventional remotely-controllable impedance-matching circuit, such as, an HF-9042 device available from Rockwell International Corporation, Cedar Rapids, Iowa.

The inductors $L_1$- $L_n$ are arranged and connected contiguously so that the length H of the antenna structure 12, as selectively configured, corresponds to the desired operating band. For example, to operate the antenna structure 12 in the lowest frequency band, all the switches $S_1$- $S_N$ are opened, so that the antenna structure 12 comprises all the inductors $L_1$- $L_N$ and the associated sections of the conductive wire 40. To operate the antenna in the highest frequency band, all the switches $S_1$- $S_N$ are closed, so that the antenna comprises a minimum number of inductors $L_N$- $L_N$-1 and the associated sections of the conductive wire 40, and the band selection wires 48. Control of the switches $S_1$- $S_N$ may be implemented using four solenoids $L_N$- $K_N$, which respond to the selector means 34 via bus 35.

Those skilled in the art will readily recognize that various modifications and changes may be made to the present invention without departing from the true spirit and scope thereof, which is set forth in the following claims.

I claim:

1. A bandwidth-enhanced antenna system for operating on one of a plurality of frequency bands, the system comprising:

an antenna element comprising:

a wire whip which is approximately one-half wavelength in length with respect to the highest frequency within said range and is approximately one-quarter wavelength in length with respect to the mid-frequency within said range and which is connected to said antenna element; and a plurality of inductors installed along said wire whip, said inductors positioned so as to be electrically isolated from one another by being spaced apart by several inches and progressively spaced more closely together toward the far-end of said antenna element, and also sized so as to be non-resonant over said range of frequencies and of greater inductance value toward the far-end of said antenna element;

a selector providing a band select signal; and a bandswitch controller coupled to the selector, activating a contiguous set of the inductors to the feed-end of the antenna element in response to a given band select signal, to allow communication using a selected one of the plurality of the frequency bands.

2. A bandwidth-enhanced antenna system, according to claim 1, wherein the contiguous set of the inductors is one inductor section which is active as part of the antenna element when communicating using a first selected one of the plurality of frequency bands and which is bypassed as part of the antenna when communicating using a second selected one of the plurality of the frequency bands.

3. A bandwidth-enhanced antenna system, according to claim 1, further including a transmitter, and an impedance matching network coupling the transmitter to the antenna element feed-end.

4. A bandwidth-enhanced antenna system, according to claim 1, further including a receiver and an impedance matching network coupling the receiver to the antenna element feed-end.

5. A bandwidth-enhanced antenna system, according to claim 1, wherein said bandswitch controller includes a plurality of switches, each of said switches having a first terminal connected to a corresponding section of the inductors and a second terminal connected to the feed-end of the antenna element.

* * * * *